US007377078B2

(12) United States Patent
Golino et al.

(10) Patent No.: US 7,377,078 B2
(45) Date of Patent: May 27, 2008

(54) MOBILE DESK WITH AN INTEGRATED AND ADJUSTABLE PRIVACY ENCLOSURE

(76) Inventors: Michael John Golino, 6 Beach Ave., Ashland, OR (US) 97520; Zlatan Vukosavljevic, 3634 7th Ave., San Diego, CA (US) 92103

( * ) Notice: Subject to any disclaimer, the term of this patent is extended or adjusted under 35 U.S.C. 154(b) by 197 days.

(21) Appl. No.: 11/452,447

(22) Filed: Jun. 13, 2006

(65) Prior Publication Data

US 2006/0283098 A1 Dec. 21, 2006

Related U.S. Application Data

(60) Provisional application No. 60/691,597, filed on Jun. 17, 2005.

(51) Int. Cl.

| | |
|---|---|
| ***A47F 10/00*** | (2006.01) |
| ***E04H 1/00*** | (2006.01) |
| ***E04H 6/06*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04F 19/00*** | (2006.01) |
| ***B66B 9/00*** | (2006.01) |
| ***A47B 37/00*** | (2006.01) |
| ***A47B 57/00*** | (2006.01) |
| ***A47G 5/00*** | (2006.01) |

(52) U.S. Cl. ..... 52/36.4; 52/36.1; 52/29; 52/239; 108/60; 108/50.01; 160/135

(58) Field of Classification Search ..... 52/36.1, 52/36.4, 29, 239, 64, 65, 143; 160/135; 108/60, 108/50.01

See application file for complete search history.

(56) References Cited

U.S. PATENT DOCUMENTS

| | | | | |
|---|---|---|---|---|
| 3,319,801 | A * | 5/1967 | Nordstrom | 211/199 |
| 3,517,623 | A * | 6/1970 | Sobel et al. | 108/187 |
| 3,588,209 | A * | 6/1971 | Nathan | 312/140.2 |
| 4,087,144 | A * | 5/1978 | Wax | 312/258 |
| 4,478,467 | A * | 10/1984 | Tyndall | 312/249.9 |
| 4,874,027 | A * | 10/1989 | Boundy et al. | 160/230 |
| 4,986,194 | A * | 1/1991 | Bollman | 108/60 |
| 5,802,778 | A * | 9/1998 | Thorp et al. | 52/36.2 |
| 5,803,562 | A * | 9/1998 | Jacobs et al. | 312/283 |
| 6,053,588 | A * | 4/2000 | Biggel et al. | 312/249.8 |
| 6,164,467 | A * | 12/2000 | DePottey et al. | 211/189 |
| D532,208 | S * | 11/2006 | Partridge | D6/332 |
| 2003/0005654 | A1* | 1/2003 | Weber et al. | 52/239 |
| 2003/0150180 | A1* | 8/2003 | Briskman | 52/239 |
| 2004/0172887 | A1* | 9/2004 | Moglin et al. | 52/36.1 |
| 2005/0178074 | A1* | 8/2005 | Kerosetz | 52/36.1 |

* cited by examiner

*Primary Examiner*—Robert Canfield
*Assistant Examiner*—Hunter M Dreidame

(57) ABSTRACT

A workstation (desk) 7 that can be assembled or disassembled without the use of tools or fasteners, mounted on casters 40, with adjustable integrated privacy enclosure panels 8, 10, 12, 14. In an open plan work environment a user of the workstation (desk) can create private, semi private and open personal workspace by pivoting the integrated privacy enclosure panels 8, 10, 12, 14, easily roll the workstation (desk) 7 to another location without disturbing other workstations (desks) 7, and create new workstation (desk) 7 configurations by connecting workstation together using the integrated privacy enclosure panels 8, 10, 12, 14 as common connecting elements. Thus a considerably more versatile workstation is provided that can enable users the ability to immediately create a multitude of workstation configurations and arrangements to suit their long term and immediate needs.

1 Claim, 4 Drawing Sheets

MOBILE DESK WITH AN INTEGRATED AND ADJUSTABLE PRIVACY ENCLOSURE

CROSS-REFERENCED TO RELATED APPLICATION

This application claims the benefit of provisional Patent Application Ser. No. 60/691,597 filled Jun. 17, 2005

FEDERALLY SPONSORED RESEARCH

Not applicable

SEQUENCE LISTING OR PROGRAM

Not applicable

BACKGROUND

1. Field of Invention

This invention relates to workstations for open plan work environments, specifically to workstations (desks) that have casters to facilitate moving the location of the workstation, integrated and adjustable privacy enclosure panels as a means of providing visual privacy and sound attenuation, and the capability to be assembled and disassembled without the use of tools or fasteners.

2. Description of Prior Art

Partition based workstations sometimes referred to as 'cubicles' are an inherently complex and expensive systems to install and re-configure, these systems rely on many small unique parts and tools to attach the work surfaces and panels to one another, and the privacy panels used are usually shared by more than one workstation.

Typically it is beyond the ability of the person who uses this type of system to make any sort of adjustment as to the location of the workstation itself, or to reconfiguring the privacy panels that are a part of the workstation.

The effectiveness of individuals who work in an open plan work environment can usually be enhanced by reconfiguring the arrangement of workstations to meet specific and ever changing needs of business. Because typical 'cube' systems are so complex, time consuming and expensive to reconfigure, many office environments simply wait until there is an overwhelming need for change before committing the time and resources to reconfiguring the furniture in the office.

Insofar as I am aware, no desk, workstation or work environment formerly developed provides the users with an easy and immediate means of: moving the workstation (desk) itself, easily adjusting the privacy panels, or assembling or disassembling the workstation (desk) without tools or fasteners.

SUMMARY

The invention, an improved workstation (desk), can be assembled or disassembled without tools or fasteners, it has casters that allow it to be easily moved, as well as adjustable privacy panels that can be pivoted to open up one or both sides of the workstation (desk). These privacy panels can also be easily removed or attached to another workstation (desk) to join two or more workstations (desks) together.

OBJECTS AND ADVANTAGES

Accordingly several objects and advantages of the invention are:

(a) to provide means of easily reconfiguring the location and arrangement of workstations (desks);

(b) to provide a workstation (desk) that the user can assemble or disassemble with out tools or fasteners;

(c) to provide a more user-friendly furniture system that allows the people who use the workstations (desks) the ability to control and modify their office lay-out themselves.

(d) to provide means of easily reconfiguring the arrangement of the workstations (desks) privacy panels;

Still further objects and advantages will become apparent from a study of the following description and accompanying drawings.

DRAWINGS

Figure 1:
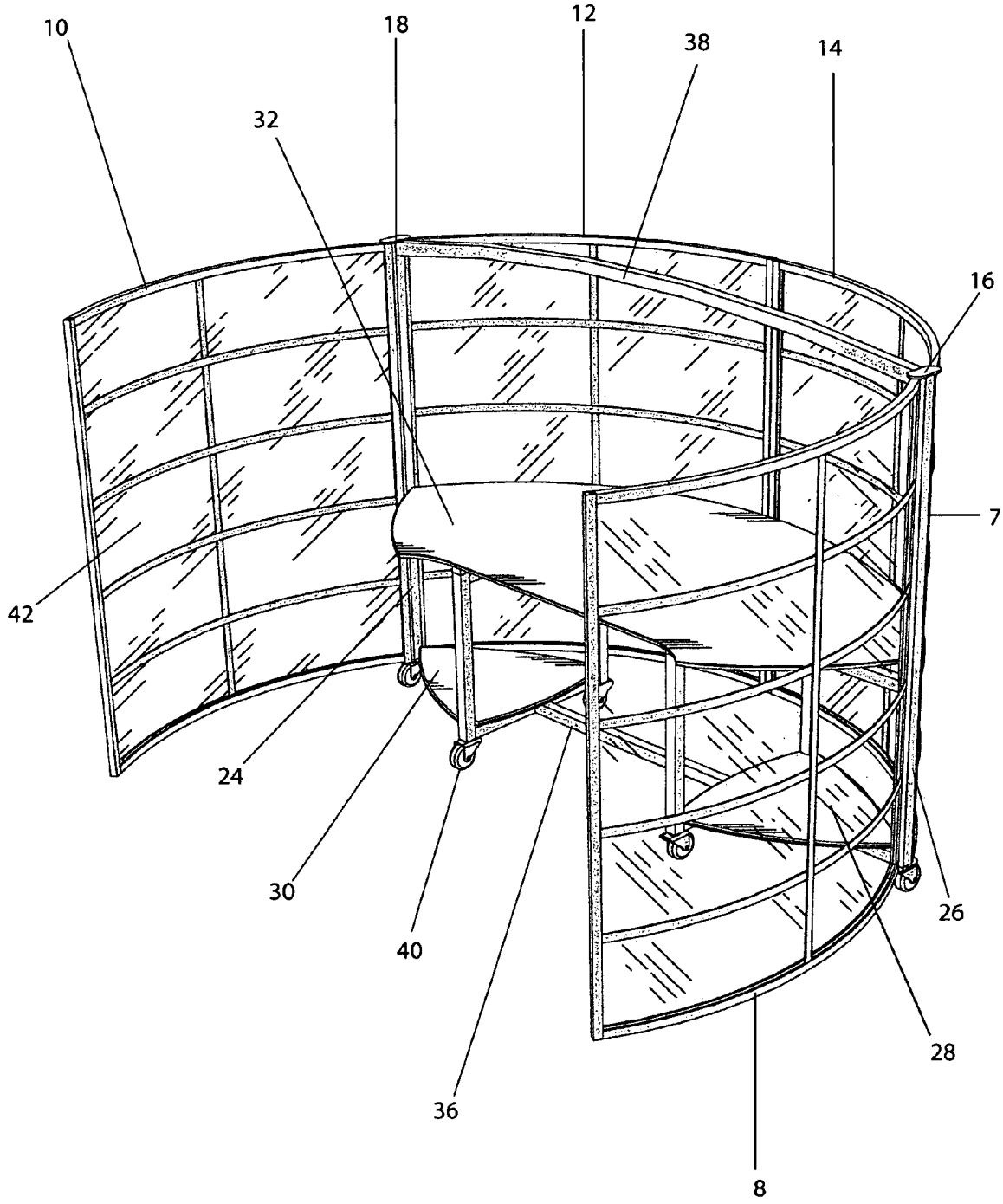
FIG. 1 is a perspective three-quarter, front view of the workstation (desk) constructed in accordance with the invention showing the two front privacy panels open.

| Reference Numerals |
|---|
| 7. workstation (desk) |
| 8. privacy panel (right front) |
| 10. privacy panel (left front) |
| 12. privacy panel (left rear) |
| 14. privacy panel (right rear) |
| 16. hinge-plug (top right) |
| 18. hinge-plug (top left) |
| 20. hinge-plug (bottom right) |
| 22. hinge-plug (bottom left) |
| 24. support pedestal (left) |
| 26. support pedestal (right) |
| 28. shelf (right) |
| 30. shelf (left) |
| 36. bottom crossbar/footrest |
| 38. top crossbar |
| 32. work-surface |
| 34. work-surface support frame |
| 40. casters (swivel) |
| 42. privacy panel sheet material (clear or translucent or opaque) |

DESCRIPTION

FIG. 1 is a perspective, three-quarter, front view of the workstation (desk) 7 constructed in accordance with the invention showing the two front privacy panels 8, 10 open. The workstation (desk) 7 has two pedestals 24, 26 that support a work-surface 32, shelves 28, 30 and four privacy panels 8, 10, 12, 14. The four privacy panels 8, 10, 12, 14 are held in place and allowed to pivot by means of vertical pins extending from four hinge-plugs 16, 18, 20, 22, two at the top 16,18 and two at the bottom 20, 22 (not shown). The hinge-plugs 16, 18, 20, 22 are plastic plugs comprised of a square plug with a flat oblong piece that has two pins extending out at right angles (see FIG. 5). The hinge-plugs 16, 18, 20, 22 insert into the top and bottom open ends of pedestals 24, 26 longest vertical component. At the bottom position hinge-plugs 20, 22 (not shown) have a hole running vertically to accommodate a caster stem. The two pedestals are connected by three components: bottom crossbar/footrest 36, work-surface support frame 34 (not shown) and top crossbar 38. The pedestals 24, 26 are identical and are made from welded metal, the vertical components of the pedestals are square tubing with their ends left open to accept: plastic inserts for the casters 40 to attach to, hinge-plugs 16, 18, 20, 22, and the four vertical components of work-surface support frame 34 (not shown). The privacy panels 8, 10, 12, 14 are constructed of lightweight aluminum frames made up of: outer frame pieces of extruded tubing with an integral reveal to hold the edge of sheet material 42, and vertical and horizontal bars that act to hold the face of sheet material 42 in place. The sheet material 42 could be clear translucent or opaque material having sound attenuating properties. The privacy panels 8, 10, 12, 14 are all identical in construction and all have holes at the top and bottom of each vertical member to accommodate the pivot pins on hinge-plugs 16, 18, 20, 22. Work surface 32 and shelves 28, 30 are made from either wood or composite material. Work surface 32 is attached to work surface support frame 34 (not shown) to create a component that can be inserted into the four open ends of the pedestal's 24, 26 shorter vertical components. Attached together, work surface 32 and work surface support frame 34 (not shown) act as a single component to hold the two pedestals in fixed position relative to one another.

Figure 2:
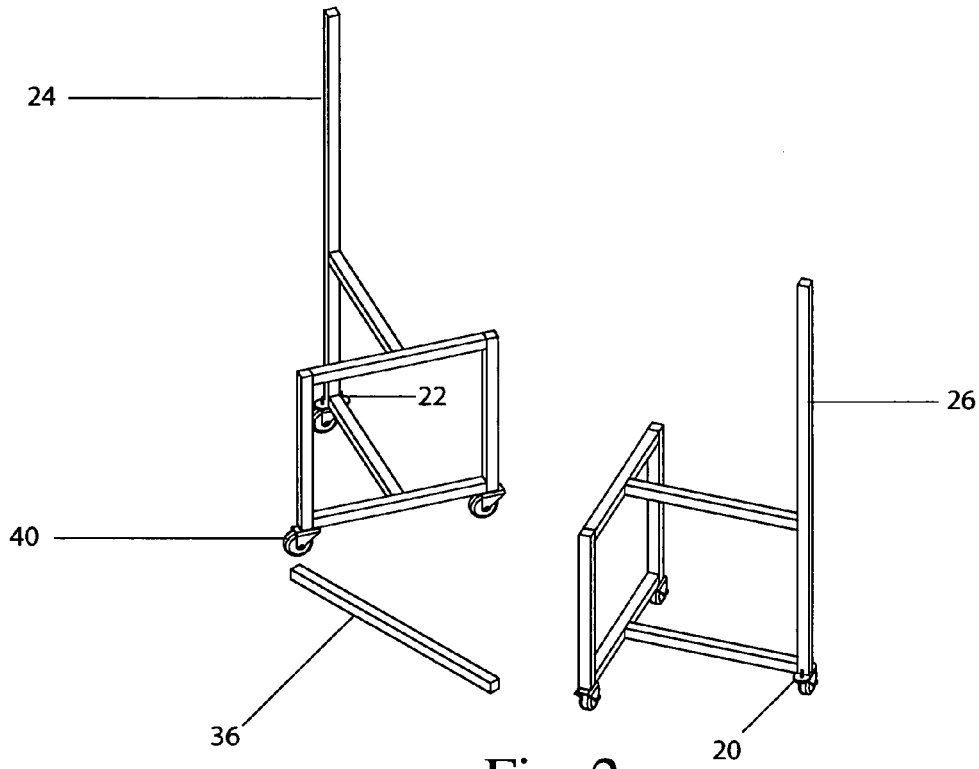
FIG. 2 is a perspective drawing showing three of the components of the workstation (desk): the support pedestals and the bottom crossbar/footrest.

FIG. 2 is a perspective drawing showing the two pedestals 24, 26 with lower hinge-plugs 20, 22 and casters 40 attached. Also shown is the bottom crossbar/footrest not attached.

Figure 3:
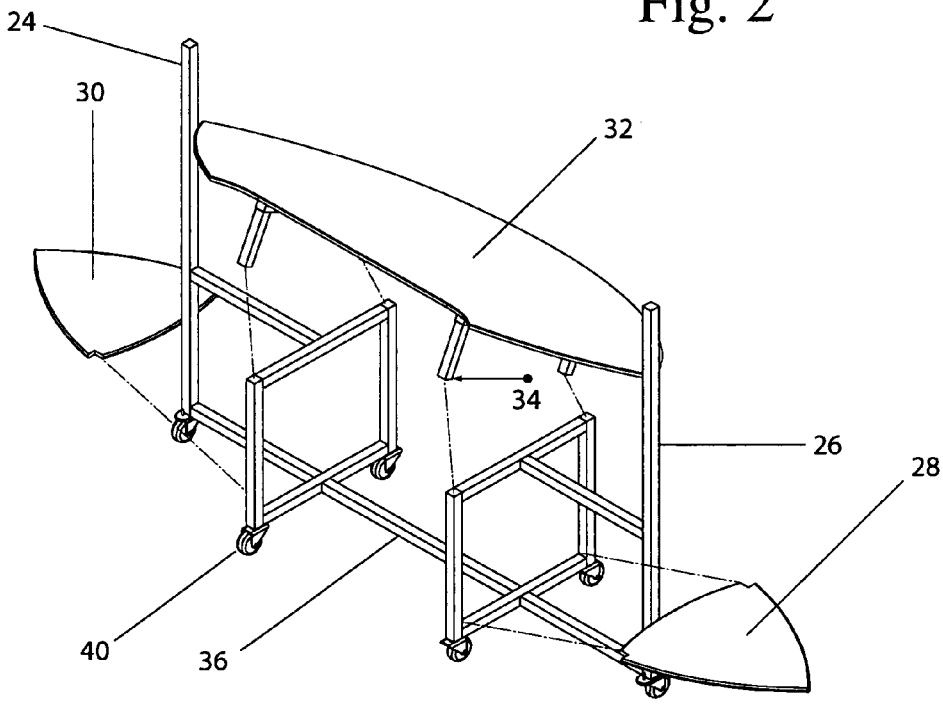
FIG. 3 is a perspective drawing showing six of the components of the workstation (desk): the support pedestals, the bottom crossbar/footrest, the two lower shelves, the work-surface, and the work-surface support frame.

FIG. 3 is a perspective drawing showing the two pedestals 24, 26 connected together by bottom crossbar/footrest 36, while work surface 32 and work surface support frame 15 as a component are about to be inserted into the open top ends of pedestal's 24, 26 shorter vertical components. Also shown are shelves 28, 30 before they have been set in place on pedestals 24, 26.

Figure 4:
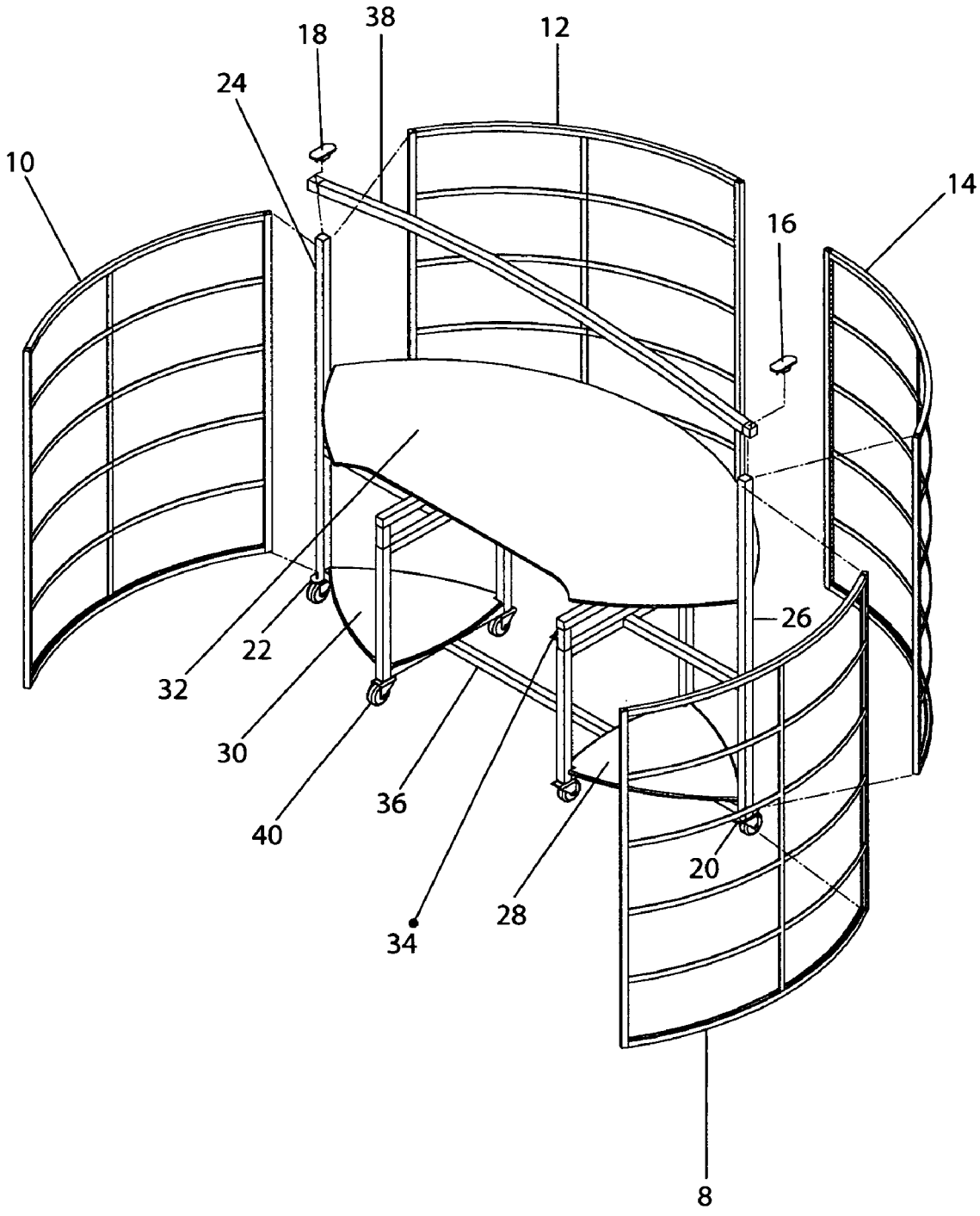
FIG. 4 is a perspective drawing partially exploded showing all of the components of the workstation (desk).
Figure 5:
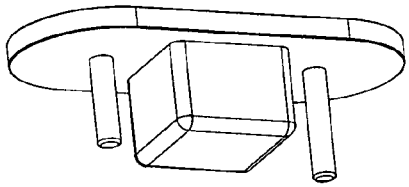
FIG. 5 is a perspective drawing showing a hinge-plug

FIG. 4 is a partial exploded view of all of the components showing work surface 32 and the work surface support frame 34 as a component partially inserted into the pedestals 24, 26 shorter vertical components. Lower crossbar/footrest 36 and shelves 28, 30 are attached and in place. Top cross bar 12 is about to be slid down over the pedestals 24, 26 taller vertical components where it will rest on a stop on this vertical component. Privacy screens 8, 10, 12, 14 are shown prior to being set onto to the vertical pins of the lower hinge-plugs 20, 22. Top hinge plugs 16, 18 are shown prior to being inserted into the top opening of tall vertical components of pedestals 24, 26 and privacy screens 8, 10, 12, 14 pivot holes. Sheet material 42 is not shown for clarity FIG. 5 is a perspective drawing showing a typical hinge-plug. The plug portion of the hinge-plug is designed to fit into the top opening of tall vertical components of pedestals 24, 26 (not shown). The pins of the hinge-plug are unequal in length and designed to fit into the pivot hole of privacy screens 8, 10, 12, 14 (not shown).

Figure 6A:
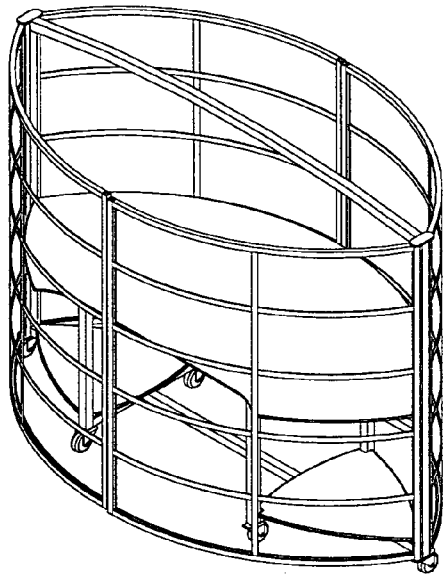
FIG. 6A is a perspective drawing showing the workstation (desk) with all privacy panels closed.
Figure 6B:
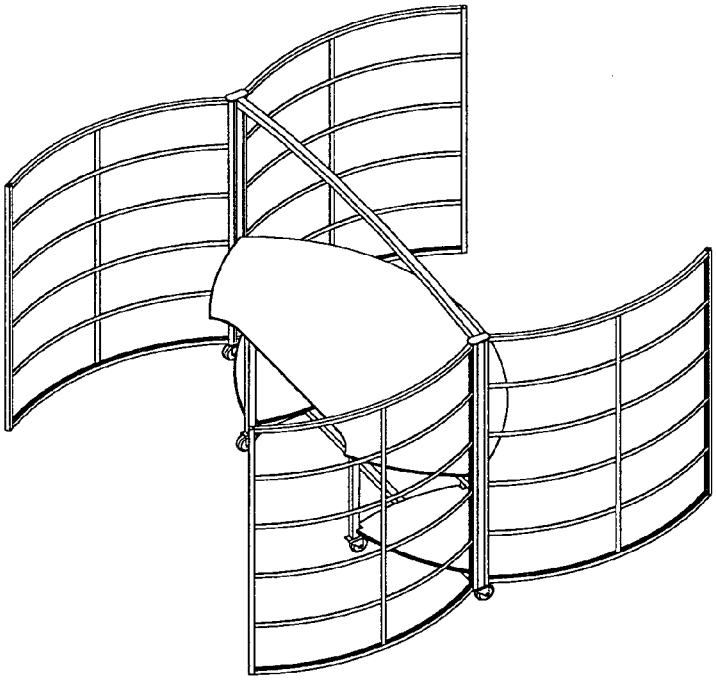
FIG. 6B is a perspective drawing showing the workstation (desk) with all privacy panels open.

FIG. 6A is a perspective drawing showing the workstation (desk) fully assembled with all privacy panels closed. Sheet material 42 is not shown for clarity FIG. 6B is a perspective drawing showing the workstation (desk) fully assembled with all privacy panels open. Sheet material 42 is not shown for clarity

Operation

In operation one uses the workstation (desk) 7 in a normal manner standing, or sitting on a chair in front of the work surface with the two front privacy panels 8, 10 open. A user can also open the back privacy panels 12, 14 to accommodate someone sitting or standing across from them, or close all panels when work is done and the user has gone home. The user can, when desired, close all of the privacy panels 8, 10, 12, 14 and roll the workstation (desk) 7 to a new location.

If a user needs to disassemble the workstation (desk) 7 to store it, or move it further than the whole unit can be rolled, they proceed as follows: first they lift off one of the top hinge-plugs 16 or 18 and remove the corresponding privacy panels of one side, they then repeat this for the other side. Next they slide off the top crossbar 38. Next they lift off the component comprised of the work surface 32 and the work surface support frame 34. Next they lift off the two shelves 28, 30. Next they disconnect the bottom crossbar/footrest 36 from the two pedestals 24, 26. Disassembly is complete. Assembly is the reverse of the above procedure.

If a user desires to create a larger workstation for one or more people they can accomplish this by taking two workstations (desks) 7 removing any one of the privacy panels 8, 10, 12, 14 and connecting two workstations (desks) 7 together with a common privacy panel 8, 10, 12, 14. Using this method there are a great number of configurations possible.

We claim:

1. A mobile work station device with integrated adjustable privacy enclosures, comprising:

(a) a sheet of rigid material having sufficient size to accommodate use by a human being for writing and working, (b) two pedestal frames of hollow tubular construction each with one tall hollow vertical member and two short hollow vertical members, said pedestal frames each having three rotatable swiveling wheels mounted thereunder for enabling said pedestal frames to roll along a surface, (c) a support frame with four elongated vertical support members, said support frame being joined to the undersurface of said sheet of rigid material for enabling said elongated vertical support members of said support frame to insert without fasteners or tools into said short vertical members of said pedestals, positioning said pedestals at either end of said sheet of rigid material, (d) a plurality of panels of tubular frame construction containing sheet material with visual and sound attenuating properties, and (e) means for attaching or detaching without tools or fasteners one edge of said panels to said tall hollow vertical member of said pedestals enabling said panels to pivot along an axis parallel with said tall hollow vertical member of said pedestal, (f) a plurality of small sheets of rigid material having sufficient size to accommodate use by a human being for storing and placing objects on, said small sheets of rigid material having a unique shape conforming to the geometry of said pedestals enabling said small sheets of rigid material to be placed in a secure fashion without fasteners or tools on the lower part of said pedestals, (g) a footrest cross-bar of rigid tubular metal, and (h) means for attaching without tools or fasteners said footrest cross-bar to the lower portion of said pedestals, (i) a cross-bar of rigid tubular metal, and (j) means for attaching without tools or fasteners said cross-bar to the upper portion of said tall hollow vertical member of said pedestals, whereby a human occupant in a work environment sitting or standing at said workstation in order to change various visual and audible environmental factors can adjust said panels by pivoting said panels, whereby said occupant can move by rolling said workstation to locate said workstation to a different location, whereby said occupant can assemble or disassemble said workstation without the use of tools or fasteners, whereby a number of users of said workstation can combine any number of said workstations into various arrangements to suit specific proximity needs of said occupants, whereby any number of said workstations can be connected together using any of said panels as common connecting elements to create new configurations of said workstation to suite the functional needs of said occupants.

* * * * *